US006012664A

United States Patent [19]

Duclos et al.

[11] Patent Number: 6,012,664

[45] **Date of Patent: *Jan. 11, 2000**

[54] WIRE SUPPLY ASSEMBLY

[75] Inventors: Mark B. Duclos, Athens; C. W. Luttrell, Watkinsville, both of Ga.

[73] Assignee: Reliance Electric Industrial Company, Cleveland, Ohio

[ * ] Notice: This patent is subject to a terminal disclaimer.

[21] Appl. No.: 09/022,263

[22] Filed: Feb. 11, 1998

Related U.S. Application Data

[62] Division of application No. 08/783,658, Jan. 15, 1997, Pat. No. 5,816,514.

[51] Int. Cl.[7] ..... B65H 49/02; B65H 63/02; B65H 43/00

[52] U.S. Cl. ..... 242/131; 242/129; 242/171; 242/485.29; 242/563

[58] Field of Search ..... 242/128, 129, 242/130, 131, 170, 563, 563.2

[56] References Cited

U.S. PATENT DOCUMENTS

| | | | |
|---|---|---|---|
| 1,848,744 | 3/1932 | Pavlas . | |
| 2,179,825 | 11/1939 | Lewis . | |
| 2,332,005 | 10/1943 | Nystrom . | |
| 2,544,348 | 3/1951 | Nystrom . | |
| 2,640,893 | 6/1953 | Stalzer . | |
| 2,719,012 | 9/1955 | Hanson . | |
| 3,195,832 | 7/1965 | Kirchmeyer . | |
| 3,304,025 | 2/1967 | Zerg . | |
| 3,371,878 | 3/1968 | Garner . | |
| 3,542,309 | 11/1970 | Willis et al. . | |
| 3,792,821 | 2/1974 | Fallon . | |
| 3,844,150 | 10/1974 | Mees et al. . | |
| 3,897,914 | 8/1975 | McCarthy et al. . | |
| 3,984,064 | 10/1976 | Bartelt . | |
| 4,150,800 | 4/1979 | Clausen et al. . | |
| 4,189,110 | 2/1980 | Drummond . | |
| 4,202,509 | 5/1980 | Horn . | |
| 4,222,535 | 9/1980 | Hosbein | 242/128 |
| 4,344,582 | 8/1982 | Rapp et al. . | |
| 4,367,852 | 1/1983 | Lazaro, Jr. | 242/131 X |
| 4,388,952 | 6/1983 | Hamane et al. . | |
| 4,451,014 | 5/1984 | Kitt et al. . | |
| 4,486,186 | 12/1984 | Grumer | 242/131 |
| 4,489,903 | 12/1984 | Titzer . | |
| 4,545,548 | 10/1985 | Kato et al. . | |
| 4,938,428 | 7/1990 | Zaman et al. . | |
| 4,941,625 | 7/1990 | Saro . | |
| 5,188,308 | 2/1993 | Tussing . | |
| 5,275,034 | 1/1994 | Del Fabro et al. . | |
| 5,374,005 | 12/1994 | Jenkins et al. . | |
| 5,451,006 | 9/1995 | Smith . | |
| 5,816,514 | 10/1998 | Duclos et al. | 242/131 |

*Primary Examiner*—Michael R. Mansen
*Attorney, Agent, or Firm*—Jeff Karmilovich; John M. Miller; John J. Horn

[57] ABSTRACT

An assembly for supplying wire from a spool includes a support for holding the spool, a sensor mounted on the support and detachably secured to an end of the spool for detecting supplying of the end of the wire from the spool, and a controller for precluding supplying of wire from the spool when the sensor detects supplying of the end of the wire. The support may hold a plurality of spools and include a plurality of sensors and indicators for sensing and indicating spool depletion. Wires may follow a wire feed path to a winder including a first portion extending generally vertically from the support, a second portion extending generally vertically from the winder, and a third portion connecting the first portion and the second portion.

18 Claims, 8 Drawing Sheets

WIRE SUPPLY ASSEMBLY

The present application is divisional application of U.S. patent application Ser. No. 08/783,658, filed Jan. 15, 1997, U.S. Pat. No. 5,816,514, the disclosure of which is incorporated by reference into the present application.

BACKGROUND OF THE INVENTION

The present invention generally relates to a wire supply assembly and more particularly relates to a compact and efficient wire supply assembly that can be spaced distant from a winding station and that indicates need for replacing spools of wire when depleted.

Manufacturers of motors, transformers, generators, etc. use winding stations to wind wire into coils. The wire is typically copper and may range in gauge from 15 to 25. The winding stations are adjustable to make coils of varying sizes and shapes from the different gauges of copper wire. Typically, winding stations are set out on a floor surrounded by numerous spools of copper wire of various gauges. A winding station may be surrounded by dozens of spools of copper wire of different gauge in order to allow for changing from one gauge to another when different coils are being made. Also, many spools of the same gauge are generally placed around a winding station so as to minimize interrupting operation of the winding station when one spool runs out.

Typically, the spools of copper wire are in the range of a foot or more in diameter and can weigh as much as 600 pounds. Therefore, replacing the spools on the floor around the winding station can be time consuming as many heavy spools may have to be moved to replace a spool which has been used up. Also, having numerous spools sitting on the floor about the winding station takes up a great amount of floor space. Further, access to the winding station for starting up, operating, or maintaining the winding station is made more difficult by the placement of the spools around the winding station. Moreover, when the type of coils made by the winding station is changed, all of the spools around the station may have to be moved. All of this moving, replacing, etc. will likely have to be done by the operator of the winding station, a relatively inefficient use of the time of a skilled laborer.

Some winding stations have included resistance meters attached to a tail end of a spool of wire in use for stopping the winding station when the spool is nearing depletion. Such resistance meters measure resistance in a piece of wire between the point at which the resistance meter is attached and the winding station. The resistance measured is a function of the diameter of the wire, and thus the gauge.

However, resistance meters are subject to a number of drawbacks. For example, resistance meters are inaccurate. They often provide signals that the wire is used up when in fact it is not. Also, resistance meters may fail to provide a signal before a wire is used up, causing the tail end of the wire to be fed into the winding station, requiring the operator of the winding station to refeed a new wire into the station and not allowing proper welding of the tail end of the first wire to the second wire which may be required for the coil being wound.

Also, resistance meters require specific programming in order to be used with different gauges of wire as resistance is a function of gauge. A computer must be used to take into account the gauge of the wire being used and the output of the resistance meter to estimate how much wire remains on the spool. If one gauge wire is used when the resistance meter is set to handle another gauge wire, a faulty depletion signal will occur. In situations where dozens of spools of wire surround the winding station, ensuring that the proper gauge wire is used with each resistance meter, and that each resistance meter is set for a specific type wire which is being used with the winding station, are difficult and problems are frequent.

OBJECTS AND SUMMARY OF THE INVENTION

The present invention recognizes and addresses the foregoing disadvantages, and others, of prior art constructions and materials.

Accordingly, it is a principal object of the present invention to provide an improved wire supply assembly that can be readily adapted to various applications.

Another object of the present invention is to provide a wire supply assembly that is mechanically simple, and relatively inexpensive to manufacture.

Still another object of the present invention is to provide a wire supply assembly that requires simple logic control of its functions.

Another object of the present invention is to provide a wire supply assembly that accurately senses depletion of wire from a spool and provides indications of that depletion and halts or precludes operation of a winding station upon sensing depletion.

Still another object of the present invention is to provide a wire supply assembly that provides ready access to the area around a winding station, and prevents inadvertent contact between operators and moving wires being fed into the winding station.

Yet another object of the present invention is to provide a supply of wires fed to each winding station great enough to continuously supply the winding station and to supply different winding tasks while minimizing down time and changeover of spools.

Still another object of the present invention is to provide a wire supply assembly that minimizes floor space required for spools of wire fed to a winding station.

To achieve at least some of these objects and in accordance with the purpose of the invention, as embodied and broadly described herein, an assembly for supplying wire from a spool is provided, the assembly including a support for holding the spool and a sensor mounted to the support and detachably secured to an end of the spool for detecting supplying of the end of the wire from the spool. A controller precludes supplying of wire from the spool when the sensor detects supplying of the end of the wire.

Preferably, during supplying of wire from the spool, when the sensor detects supplying of the end of the wire, the controller halts supplying wire from the spool.

In accordance with another aspect of the present invention, an assembly is provided for supplying wire from a plurality of spools to a winder, the assembly including a support for holding the spools, and a plurality of sensors, each sensor associated with one of the spools for detecting depletion of wire from the spool. A plurality of indicators is provided, each indicator associated with one of the sensors for indicating depletion of the spool associated with the sensor.

Optionally, each indicator may be disposed on the support adjacent the associated sensor and spool. Also, the winder may be spaced from the support, the wire following a feed path from the support to the winder, each indicator being disposed at an end of the feed path adjacent the winder. Further, an input device may be provided for a user to indicate from which spool wire is being supplied to the winder.

In accordance with yet another aspect of the present invention, an assembly is provided for supplying wire from a spool to a winder disposed on a floor, the assembly including a support disposed on the floor for holding the spool, and wire guides defining a feed path disposed between the support and the winder. The feed path includes a first portion extending generally vertically from the support, a second portion extending generally vertically from the winder, and a third portion connecting the first portion and the second portion.

Optionally, the wire guides supporting the third portion of the feed path may be secured to a ceiling, or secured beneath the floor.

Other objects, features, and aspects of the present invention are discussed in greater detail below.

BRIEF DESCRIPTION OF THE DRAWINGS

The accompanying drawings, which are incorporated in and constitute a part of this specification, illustrate one presently preferred embodiment of the invention and, together with the written description, serve to explain the principles of the invention.

DETAILED DESCRIPTION OF THE PREFERRED EMBODIMENT

Figure 1:
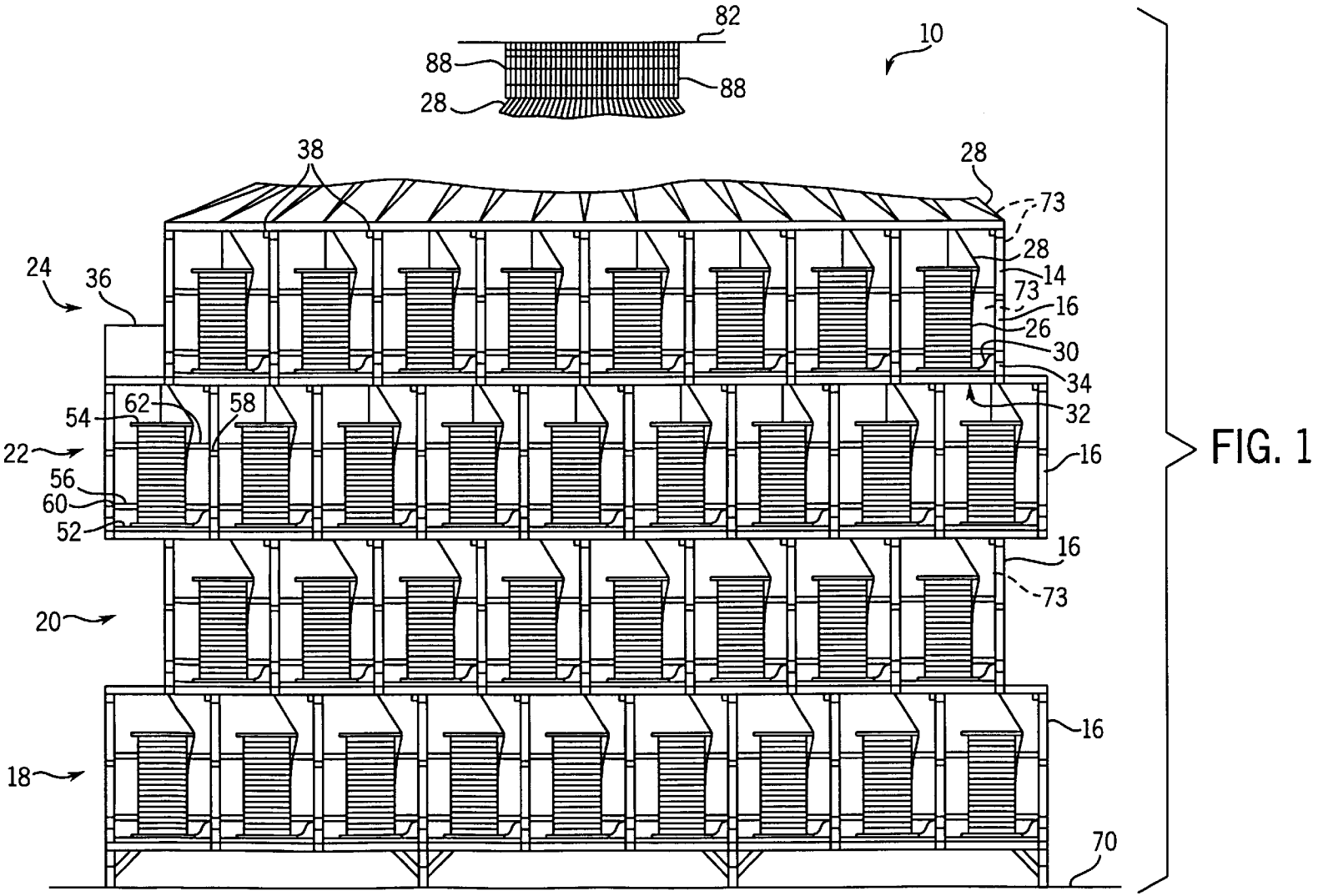
FIG. 1 is a front view of a support according to the present invention holding a plurality of spools.

Reference will now be made in detail to the presently preferred embodiment of the invention, one or more examples of which are illustrated in the accompanying drawings. Each example is provided by way of explanation of the invention and not limitation of the invention. In fact, it will be apparent to those skilled in the art that various modifications and variations can be made to the examples described herein without departing from the scope or spirit of the invention. For example, features illustrated or described as part of one embodiment can be used on another embodiment to yield a still further embodiment. Thus, it is intended that the present invention includes such modifications and variations as being within the scope of the appended claims and their equivalents. The numbering of the components in the drawings is consistent throughout the application, with the same or like components having the same or like numbers in each of the drawings.

Figure 2:
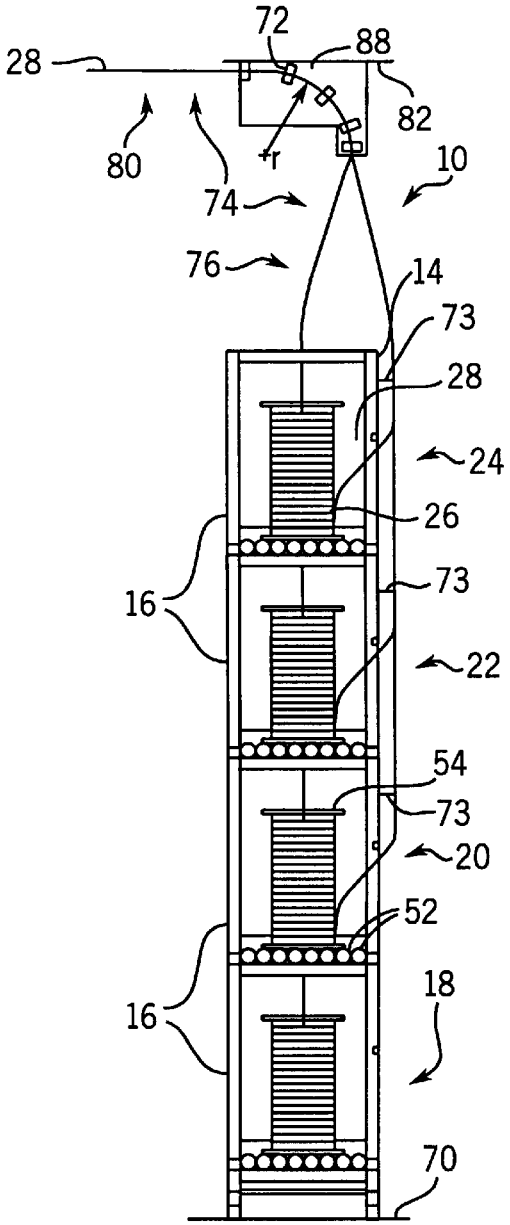
FIG. 2 is a side view of the support of FIG. 1.
Figure 4:
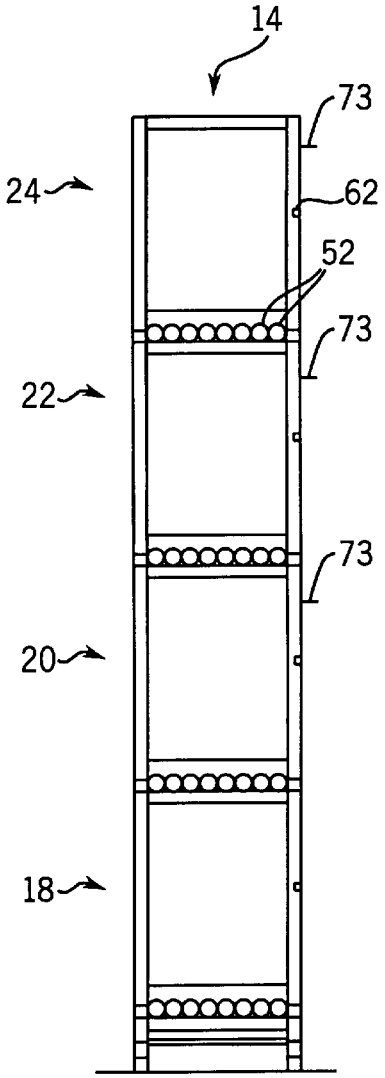
FIG. 4 is a side view of the support as shown in FIG. 3.

A preferred embodiment of a wire supply assembly 10 according to the present intention is depicted generally in FIGS. 1, 2, 11, and 12. The wire supply assembly 10 supplies wire to a winding station (i.e., winder) 12, and includes a support 14. As shown in FIGS. 1 and 2, support 14 includes at least one compartment 16, and preferably includes a plurality of compartments. In the embodiment shown in FIGS. 1 and 2, support 14 includes thirty-four compartments arranged staggered on four levels 18, 20, 22, and 24. If desired, support 14 could include only a single compartment 16, and a plurality of such supports 14 could be provided, rather than stacking the compartments 16 together to form a large support as shown. Stacking numerous compartments 16 together as shown in FIGS. 1 and 2 simplifies routing wire to a winding station, as will be described below.

Compartments 16 may be manufactured individually and then connected to form the levels, which can be connected to form a multi-compartment, multi-level support. Alternatively, levels can be constructed individually and then connected to form a support. Preferably, compartments 16 are made of tubular steel, although other like materials could be used.

As shown in FIGS. 1 and 2, each compartment 16 houses one spool 26 of wire 28. Preferably, as shown best in FIGS. 5 and 6, each compartment 16 includes a plurality of rollers 52 for moving spools 26 into and out of the compartment. Spools 26 of wire 28 may be wound around holders 54 of any conventional type, as shown in FIGS. 1 and 2, or may be wound into loops without holders. Either way, rollers 52 aid in the insertion and removal of spools and/or holders into or out of compartments 16. Typically, forklifts (not shown) are used to lift the spools 26 into place.

Figure 3:
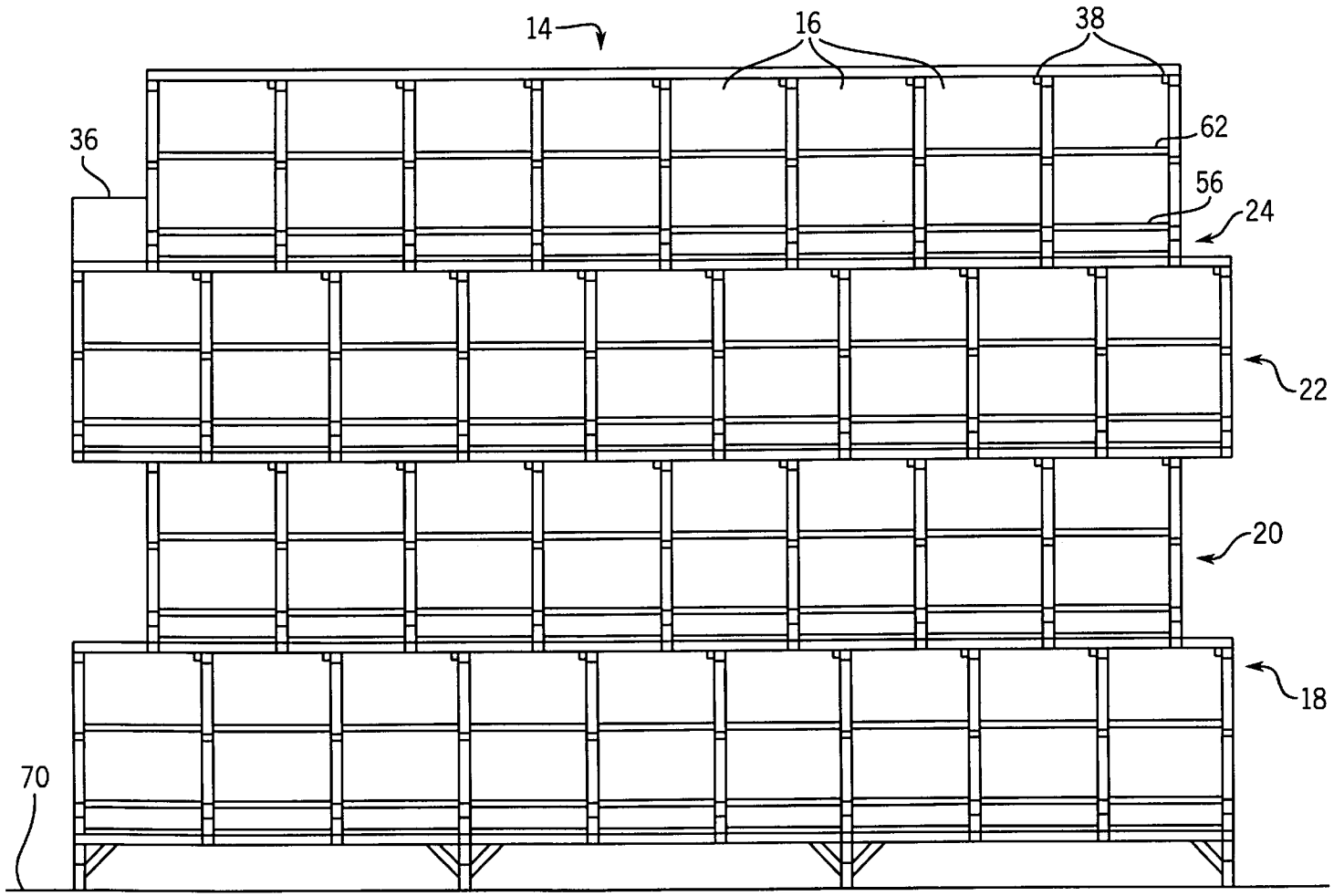
FIG. 3 is a front view of the support of FIG. 1 with the spools removed.
Figure 5:
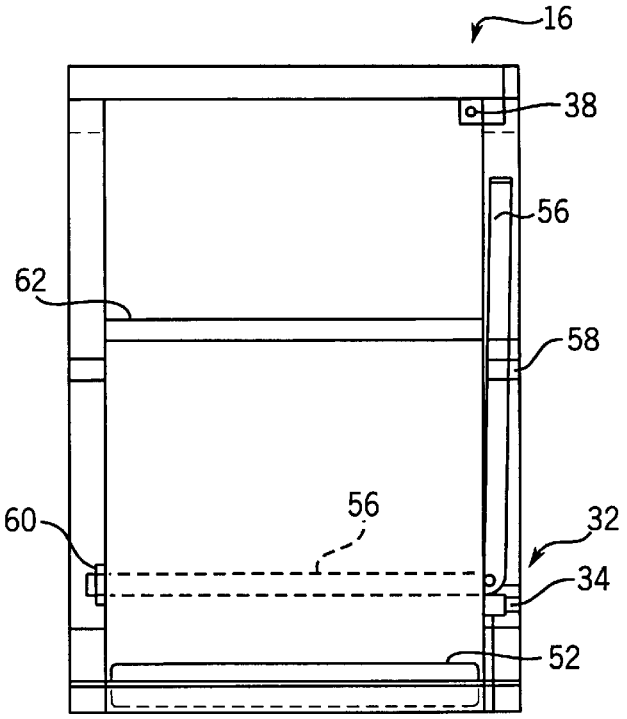
FIG. 5 is a front view of one compartment of the support as shown in FIG. 3.
Figure 6:
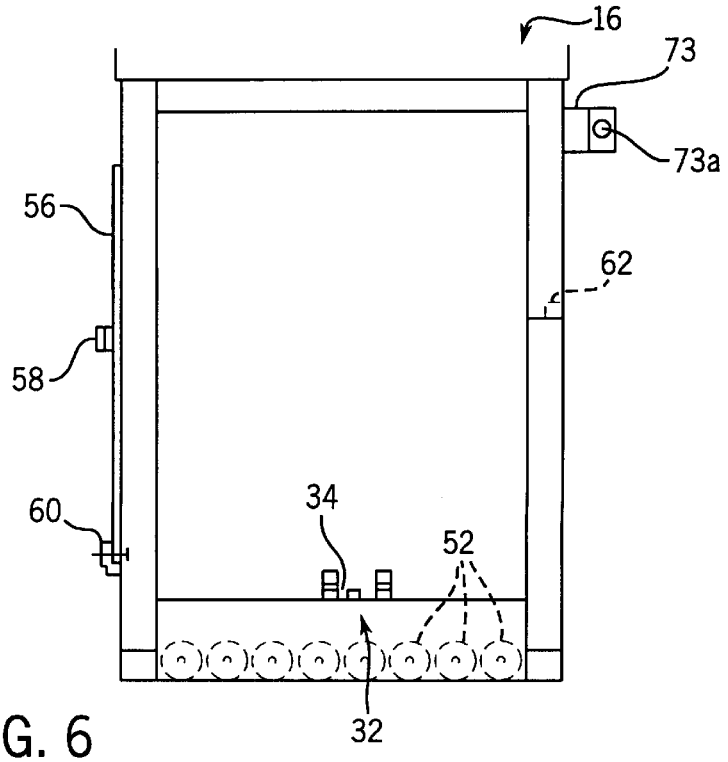
FIG. 6 is a side view of the compartment of FIG. 5.

As also shown in FIGS. 5 and 6, a front retaining bar 56 is hingedly mounted to a front surface of each compartment 16. Clips 58, 60 are provided for holding front retaining bar 56 in either an open or closed position. (FIG. 5 shows bar 56 in an open position and FIG. 3 shows a plurality bars 56 in closed positions). As also shown in FIGS. 3–6, a rear retaining bar 62 extends across the rear of each compartment 16 for preventing spools 26 from rolling or tipping out of the compartment during insertion or use.

Figure 13:
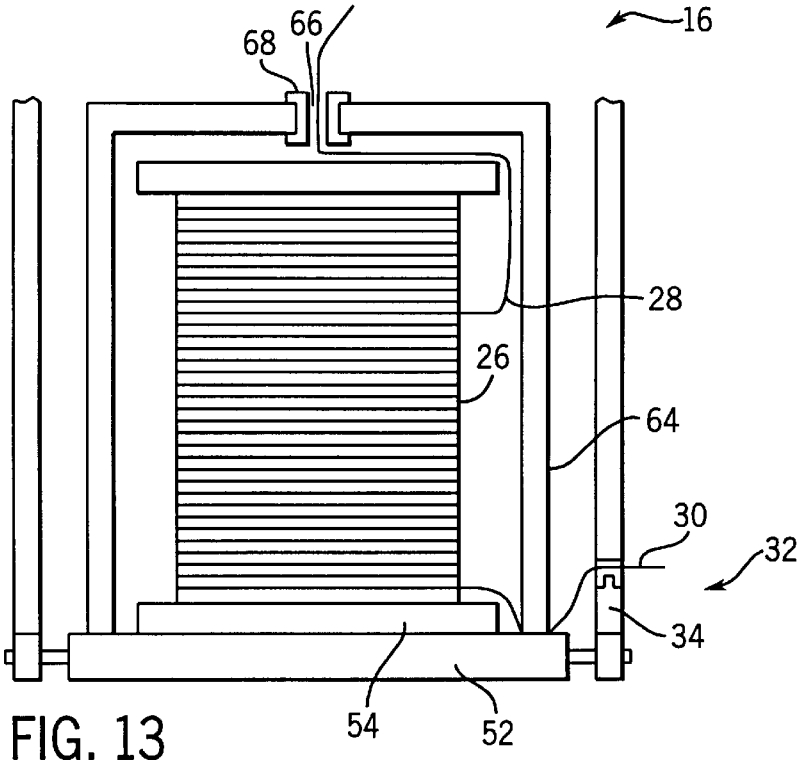
FIG. 13 is a cutaway view of a spool in a compartment of the support of FIG. 1, with an optional cover placed atop the spool.

As shown in FIG. 13, a cover 64 may be disposed over the spool 26 in order to preclude "ballooning" of wire during feeding from the spool. Cover 64, which in this case resembles an inverted garbage can, includes an opening 66 in which a low-friction eyelet 68 is disposed. Wire 28 is supplied from spool 26 through eyelet 68. Preferably, eyelet 68 is made of a low-friction material such as Heanium, made by Heany Industries. Use of such a low-friction material is important in that friction causes undesirable stretching of wire 28 which can lead to breakage or decreased performance of the product ultimately manufactured from the wire.

As shown in FIGS. 1, 5, 6, and 13, each compartment 16 includes a sensor 32 which may be mounted to the support 14 and detachably secured to an end 30 of spool 26. Sensor 32 may be mounted anywhere within compartment 16 of support 14, but is preferably located near a lower portion of the compartment for ease of connection with end 30 of spool 26. Preferably, sensor 32 is a limit switch 34 into which end 30 is placed. As wire is taken up from spool 26 by winding station 12, end 30 will eventually be pulled from limit switch 34. When end 30 is not threaded into limit switch 34, limit switch 34 generates a signal indicating that no wire is being held. Thus, limit switch 34 generates a signal if no end 30 of a wire 28 has been placed into it or if an end of a wire has been pulled from it.

A controller 36 is provided for receiving signals from each sensor 32 and controlling other portions of wire supply assembly 10 accordingly. For example, controller 36 may preclude operation of winder 12 when sensor 32 detects that an end 30 of wire 28 has been removed from a limit switch 34. Depending on the complexity of the programming used in controller 36, the controller may operate in one of at least two ways. First, controller 36 can determine how many sensors 32 indicate that wire 28 is present and, upon an increase in the number of such "empty" sensors, controller 36 will halt operation of winder 12. Alternately, an input may be provided for the operator of winder 12 to indicate to controller 36 which wire 28 is being used by the winder. Thus, only when the sensor 32 corresponding to the wire 28 in use indicates that its end 30 has been pulled, would controller 36 stop operation of the winder 12. The second type of operation precludes inadvertent stoppage of winder 12 when, for example, a spool of a wire not being used for winding is removed from the support for some reason.

A suitable choice for controller 36 is a programmable logic computer (PLC) such as model SLC 500, made by Allen-Bradley, although any other controller that can provide the functions above is acceptable. Alternately, hard-wired circuitry, relays, software, etc. could be substituted for the PLC and used as controller 36. Preferably controller 36 is mounted on support 14 and is connected to each sensor 32 by wiring (not shown), although controller 36 could be mounted anywhere convenient for electrical connection.

Preferably, the present invention includes a plurality of indicators each associated with a given one of the spools 26 for indicating depletion of the spool. The indicators may be located in one of at least two places, or both. For example, as shown in FIGS. 1 and 5, indicators 38 are disposed on support 14. Each indicator 38 is electrically connected to controller 36 by wiring (not shown). When an end 30 of a wire 28 is pulled from a sensor 32, a corresponding signal is sent to controller 36, which sends a further signal to illuminate corresponding indicator 38. Upon illumination of an indicator 38, a support stocker will be informed which spool 26 should be replaced. Indicators 38 are particularly useful if covers 64 are placed over the spools 26, because depletion of a spool under a cover is not visually evident. The support stocker can be an employee of lower skill than the winding station operator to improve the cost-effectiveness of the total winding operation.

Preferably, each indicator is an LED or other electric device. Alternately, indicator 38 could comprise a mechanical device activated by sensor 32 when end 30 of wire 28 is removed. However, it is expected that an LED would be most reliable for use as indicator 38.

Figure 9:
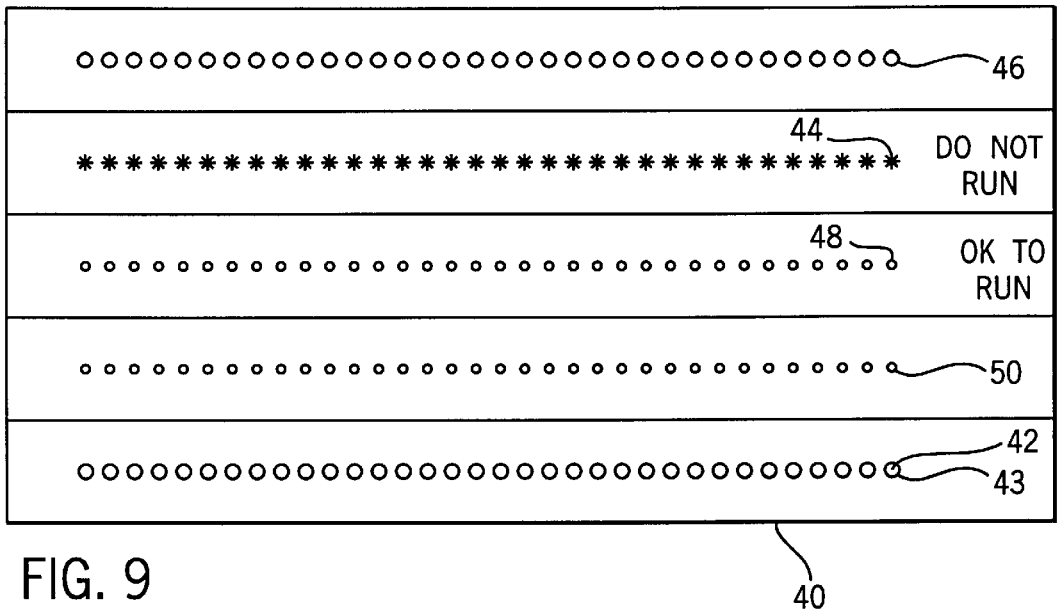
FIG. 9 is a front view of a wire board according to the present invention.
Figure 10:
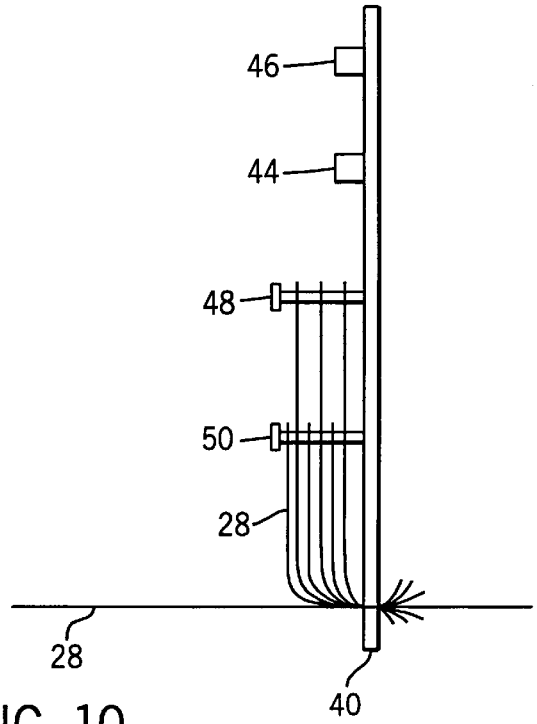
FIG. 10 is a side view of the wire board of FIG. 9.

Indicators may also be disposed at the end of the wire feed path, which will be described below, adjacent winder 12. For example, a control board 40 as shown in FIGS. 9 and 10 may be disposed adjacent winder 12. Control board 40 includes a plurality of holes 42 through which wires 28 may pass. One hole 42 is provided for each compartment 16. Therefore each spool 26 provides wire to be fed through a specific hole 42 in control board 40. Each hole 42 should have a low-friction eyelet 43 for contacting the wire.

Indicators 44, which are preferably also LED's, are provided on control board 40, each indicator 44 corresponding to a particular hole 42, and therefore to a particular spool 26 mounted in support 14. Indicators 44 are connected to controller 36 by wiring (not shown). When an end 30 of a wire 28 is pulled from a sensor 32, a corresponding signal is sent to controller 36, which sends a further signal to illuminate corresponding indicator 44.

Upon illumination of an indicator 44, an operator of the winder will be informed that the wire 28 extending through a given hole 42 in control board 40 has been supplied from its spool 26 to the point that its end 30 is no longer held by sensor 32. An illuminated indicator could also mean that no spool 26 is present in a given compartment 16, or that a spool which is present is not properly connected to its sensor 32.

Optionally, a series of input devices 46, such as buttons, may be provided on control board 40 corresponding to holes 42. Input devices 46 are electrically connected to controller 36 by wiring (not shown). An operator of winder 12 may indicate to controller 36 which wire 28 is being used by the winder by using the input device 46 corresponding to the hole 42 through which that particular wire is passed. Thus, only if sensor 32 corresponding to that particular wire 28 indicates end 30 of the wire has been removed does controller 36 then halt winder 12. In this way, winder 12 is not stopped inadvertently when spools 26 not being supplied to winder are changed or moved, or if compartments 16 are empty of spools, or if spools are improperly installed in compartments 16 without ends 30 being connected to sensors 32.

Optionally, an indicator 90 (see FIG. 14) such as an LED is also provided on the winding station 12 to let the operator know that the winding station has stopped because a sensor 32 has indicated wire depletion. A reset button 92 may be provided on the winding station 14 to be pressed by the station operator once the operator has switched to a new wire after such a stoppage. The pressing of reset button 92 indicates to controller 36 that winding station 12 is in condition for restarting, and controller may be programmed to extinguish corresponding indicator 44 upon pressing of reset button 92, if desired.

As shown in FIGS. 9 and 10, two sets of wire retaining devices 48, 50 may be provided on control board 40. Each set of devices includes one device corresponding to each hole 42 in control board 40. As shown in FIGS. 9 and 10, wire retaining devices 48, 50 may be tie-down studs extending from control board 40. Alternately, wire retaining devices 48, 50 could be clips, additional holes, or any other devices suitable for holding wire ends and preventing them from sliding out of holes 42. One set of the wire retaining devices 48 is used for wires 28 that are not in condition to be used by winder 12, and the other set of wire retaining devices 50 is used for wires 28 that are in condition to be used by winder 12. For example, wires 28 to be placed on wire retaining devices 50 are properly threaded through feed system to support 14, and have their ends 30 held within sensors 32, thereby causing their corresponding indicators 44 on control board 40 to be extinguished. If an end 30 of a wire 28 is pulled from its sensor 32, its indicator 44 will be illuminated, and the operator can place that wire on the corresponding wire retaining device 48 to prevent accidental attempted use of that wire prior to replacement of its spool 26.

It should be understood that the wire retaining devices 48, 50 are optional, and that indicators 44 alone can provide an indication to the operator as to which wire 28 should or should not be used in winder 12. Also, indicators 44 and wire retaining devices 48, 50 may be replaced by automatic devices such as clamps or shields preventing use of a wire when not suitable. Where wire retaining devices 48, 50 are provided, the reset button 92 may be used to extinguish the associated indicator 44 when wire is moved from device 50 to device 48. It is generally desirable, however, that the corresponding indicator 38 remain lit until the spool is replaced.

Figure 14:
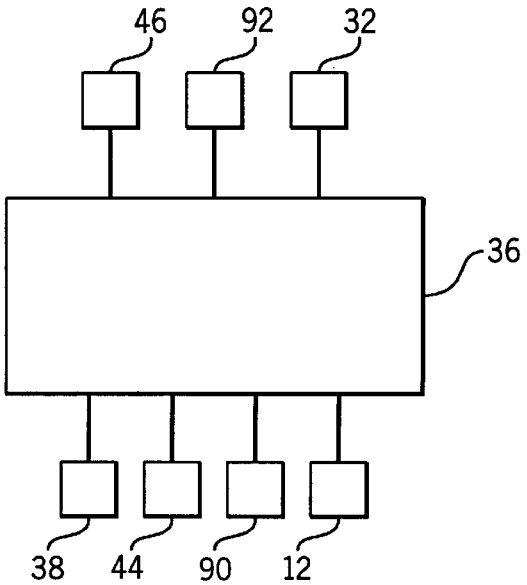
FIG. 14 is a diagram showing connection of the controller to various input and outputs of the present invention.

FIG. 14 shows operational interconnection of controller 36 with various inputs and outputs. As shown, controller 36 receives signals from sensors 32, input devices 46, and reset button 92. Controller 36 provides illumination signals to indicators 38, 44, and 90, and a shut-off signal to winder 12.

Figure 11:
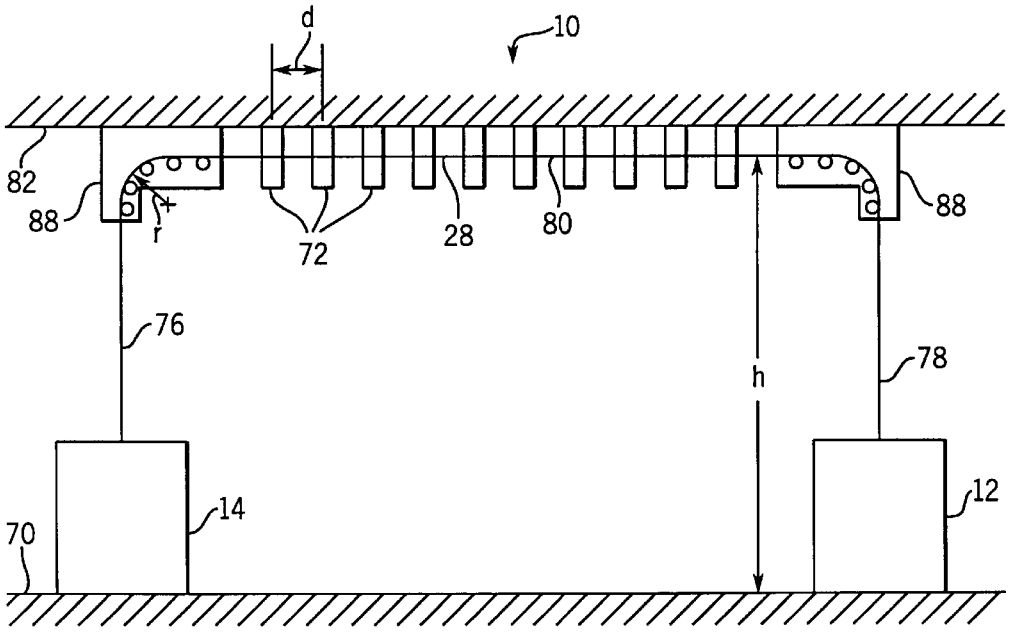
FIG. 11 is a diagram of one possible feed path connecting a support and a winding station according to the present invention.
Figure 12:
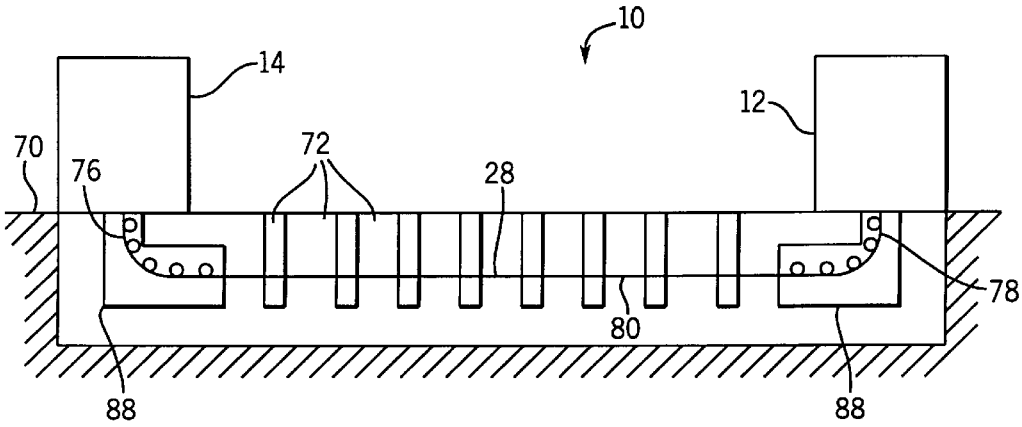
FIG. 12 is a diagram showing an alternate feed path to that shown in FIG. 11.

As shown in FIGS. 1 and 2, winder 12 and support 14 are disposed on a floor 70. Wire guides 72 define a feed path 74 disposed between winder 12 and support 14. As shown in FIG. 11, feed path 74 preferably includes first portion 76 extending generally vertically from the support 14, second portion 78 extending generally vertically from winder 12, and a third portion 80 connecting first portion 76 and second portion 78. The wire guides 72 supporting third portion 80 may be secured to a ceiling 82. Alternately, as shown in FIG. 12, the wire guide 72 supporting third portion 80 may be secured beneath floor 70. In either of the configurations of FIGS. 11 or 12, the wires 28 in feed path 74 are kept out of harms' way. Access to the immediate perimeter of winder 12 and support 14 is provided, and one may walk either under or over the portion of the feed path extending between winder 12 and support 14.

Third portion 80 may be disposed at a height h high enough for people to walk under or forklifts to ride under, as much as 8 feet or higher, limited only by the height of the ceiling of the building in which the assembly 10 is located. Further, winder 12 and support 14 may be disposed distantly from each other, and may even be in separate rooms of a building. For example, third portion 80 may be as long as 20 feet or longer, and applicants expect third portion could be hundreds of feet long, limited only by the ability of the winder to pull wire and the mechanical strength of the wire. Instead of direct ceiling mounting, third portion 80 could also be mounted on stands mounted on top of floor 70 within the scope of the invention.

Figure 7:
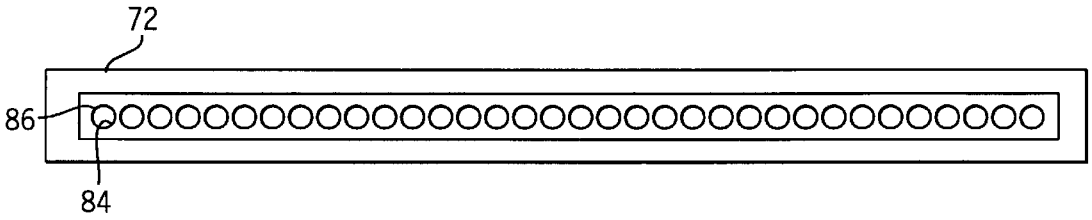
FIG. 7 is front view of a wire guide according to the present invention.
Figure 8:
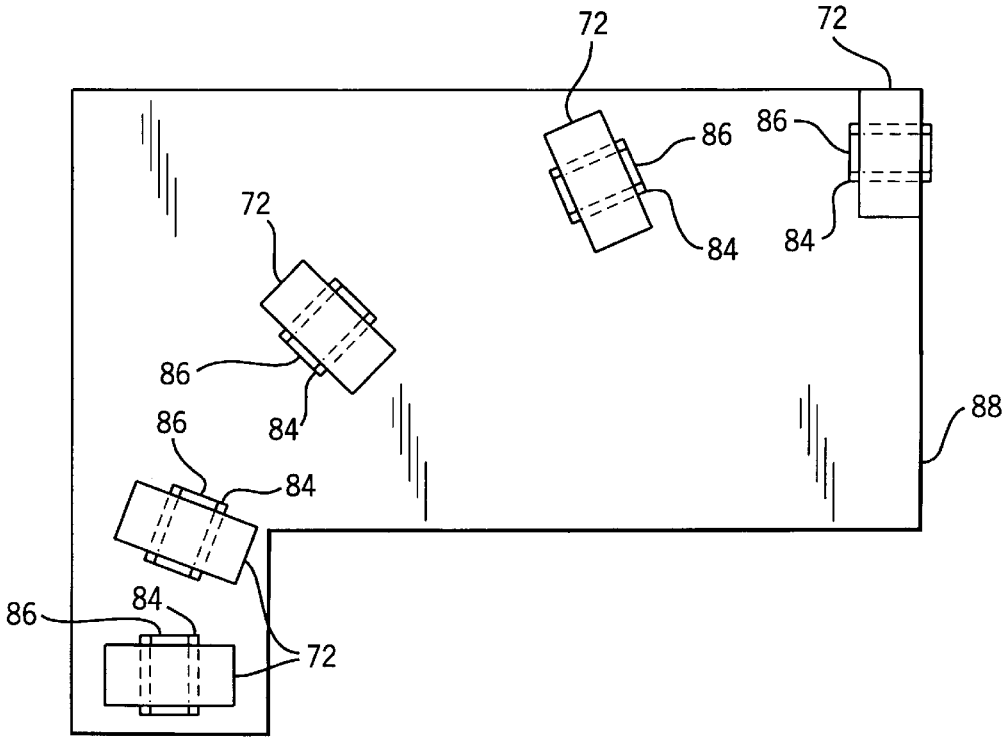
FIG. 8 is a side view of a plurality of wire guides arranged to provide a curve in a feed path according to the present invention.

Preferably, wire guides 72 include eyelets 84 in openings 86 for guiding wires 28. Eyelets 84 can be made of the same material as eyelets 68, and should provide minimal friction. Preferably also, wire guides 72 should be spaced so that any curve in feed path 74 has a radius of curvature of greater than about 12 inches. For example, as shown in FIGS. 2, 7, and 8, wire guides 72 are mounted on plates 88 so that curves made by wires 28 passing along feed path 74 have a radius of curvature of r of greater than about 12 inches. Also, adjacent wire guides 72 along feed path 74 should be spaced a distance d of no more than about 4 feet apart. Minimizing the distance between wire guides 72 reduces vibration of wire along feed path 74 preventing tangling of adjacent wires and minimizing friction due to vibration. As shown in FIGS. 1 and 2, wire guides 73 on the back of support 14 may be staggered to allow travel of wire along the support without tangling.

As shown in FIGS. 1–4, wire guides 73 may be placed on a rear surface of support 14 for guiding wires 28 to guides 72. Wire guides 73 may include plates having ceramic eyelets, as above, or may include a tensioning device 73*a* (see FIG. 6) for preventing run out of wire from spools 26. Wire guides 73 may be staggered on support 14 to provide a relatively straight and orderly travel of wire 28 out of spools 26. Tensioning device 73*a* is preferably a gravity-operated check ball.

Wire supply assembly 10 is operated as follows. First, compartments 16 in support 14 are loaded with spools 26, most likely by a forklift having a roller bed attached to its forks. Ends 30 of spools 26 are placed in sensors 32, covers 64 are put in place, and wires 28 are fed from spools 26 along feed path 74 through various wire guides 72, 73 to control board 40. Each wire 28 is looped around a wire retaining device 50, assuming indicator 44 still indicates that end 30 of the corresponding wire is held by sensor 32.

The winder operator selects a wire from wire retaining device 50 for which the corresponding indicator 44 is not illuminated, and threads it into the winder 12. Winder 12 winds wire 28 until end 30 of the wire is pulled from sensor 32. Sensor 32 signals controller 36 that end 30 has been pulled out, and controller 36 signals winder 12 to stop operation. Controller 36 also causes corresponding indicator 38 on support 14, corresponding indicator 44 on control board 40, and indicator 90 on winder 12, to be illuminated.

At that point, the operator cuts wire 28 which was being fed to winder 12, and pig tails it to another wire of similar gauge hanging on a wire retaining device 50 for which an indicator 44 is not illuminated and presses reset button 92. The operator, or preferably another person, places a new spool 26 under the cover 64 in the compartment 16 which had been feeding wire 28, cold welds end 30 of the old wire to a leading end of the new spool and attaches a trailing end 30 of the new spool to sensor 32. Once so connected, new spool 26 is ready for use, sensor 32 sends a signal to controller 36 indicating that end 30 is in place, and controller 36 accordingly turns off indicators 38 and 44, if not already turned off by reset button 92. When the operator sees that indicator 44 is no longer illuminated, the operator may move the cut end of wire 28 from wire retaining device 48 to wire retaining device 50 indicating that the wire is now ready for use by winder 12.

If the operator wishes to change gauge of wire prior to using up a spool 26, the operator simply cuts the wire being used, letting the wire tail run into the winder 12, and places the other cut end on wire retaining device 50, indicating that wire 28 is still suitable for use (i.e., spool 26 is not empty). The operator then selects a different gauge wire from the corresponding wire retaining device 50 assuming corresponding indicator 44 is not illuminated and feeds that wire 28 into winder 12. The process then continues as described above.

It should be apparent to those skilled in the art that various modifications and variations can be made in the present invention without departing from the spirit and scope of the invention. For example, parts indicated and described as separate parts can be combined together into single parts, or vice versa. For example, support 14 and feed path 74 may be combined with other machines that use wire other than the winder 12 described herein. Also, as mentioned above, various designs of indicators 38 and 44, controller 36, and sensors 32 may be utilized within the scope of the invention.

What is claimed is:

1. An assembly for supplying wire from a plurality of spools to a winder disposed on a floor comprising:

a support disposed on the floor for holding the spools, the support including a plurality of compartments, each compartment for receiving one of the spools, a plurality of sensors, each sensor associated with one of the spools for detecting depletion of wire from the spool;

wire guides defining a feed path disposed between the support and the winder, the feed path including a first portion extending generally vertically from the support, a second portion extending generally vertically from the winder, and a third portion connecting the first portion and the second portion, the wire guides being configured so that wire from each of the spools may be simultaneously disposed in the first, second, and third portions of the feed path; and a controller for precluding supplying of wire from the depleted spools when the sensor associated with the spool detects depletion while wire from the depleted spool is still disposed in the first, second, and third portions of the feed path.

2. The assembly of claim 1, wherein the wire guides supporting the third portion of the feed path are secured to a ceiling.

3. The assembly of claim 1, wherein the wire guides supporting the third portion of the feed path are secured beneath the floor.

4. The assembly of claim 1, wherein the third portion of the feed path is disposed at a height of greater than about eight feet above the floor.

5. The assembly of claim 1, wherein the third portion of the feed path is substantially longer than either of the first portion or the second portion.

6. The assembly of claim 5, wherein the third portion is longer than about 20 feet.

7. The assembly of claim 1, wherein the wire guides are spaced so that the feed path includes curves having a radius of curvature greater than about 12 inches.

8. The assembly of claim 1, wherein a plurality of the wire guides are disposed along the third portion and adjacent wire guides disposed along the third portion are spaced no more than about 4 feet apart.

9. The assembly of claim 1, wherein the wire guides include low-friction eyelets for contacting the wire.

10. The assembly of claim 1, further including a plurality of indicators, each indicator associated with one of the sensors for indicating depletion of the spool associated with the sensor.

11. The assembly of claim 10, wherein the controller activates the indicator associated with the depleted spool responsive to the associated sensor detecting depletion.

12. The assembly of claim 10, wherein the feed path has a first end adjacent the support and a second end adjacent the winder.

13. The assembly of claim 12, wherein the indicators are disposed at the first end of the feed path.

14. The assembly of claim 12, wherein the indicators are disposed at the second end of the feed path.

15. The assembly of claim 1, further including an input device for a user to indicate from which spool wire is being supplied to the winder.

16. The assembly of claim 1, wherein each sensor is a limit switch attached to the end of the wire or the associated spool.

17. The assembly of claim 1, wherein each compartment includes a plurality of rollers for supporting the associated spool.

18. The assembly of claim 1, further including a plurality of covers, each cover covering one of the spools and defining an opening therethrough for supplying wire from the spool.

* * * * *